United States Patent [19]

Wehl

[11] Patent Number: 4,755,787

[45] Date of Patent: Jul. 5, 1988

[54] MEANS FOR MOUNTING A BIMETAL BLADE IN A THERMOSTATIC SWITCH

[75] Inventor: Glenn E. Wehl, Canton, Ohio

[73] Assignee: Portage Electric Products, Inc., North Canton, Ohio

[21] Appl. No.: 129,462

[22] Filed: Dec. 7, 1987

[51] Int. Cl.[4] ..... H01H 37/04; H01H 61/08

[52] U.S. Cl. ..... 337/372; 337/380

[58] Field of Search ..... 337/372, 380, 112

[56] References Cited

U.S. PATENT DOCUMENTS 3,067,306 12/1962 Epstein ..... 337/372

3,851,288 11/1974 Stoll ..... 337/372

*Primary Examiner*—H. Broome

*Attorney, Agent, or Firm*—McAulay, Fields, Fisher, Goldstein & Nissen

[57] ABSTRACT

The present invention provides, in a preferred embodiment, a thermostatic switch having a bimetal blade connected, at one end, to a terminal arm by means of a fastener. In accordance with the present invention, a weld electrically connects the one end of the blade to the terminal arm. The weld is located so that the fastener is located between the weld and a central, flexing portion of the bimetal blade. As a result of the placement of the weld and the fastener, weakening of the central flexing portion of the blade does not occur as is the case of a prior art connection in which the blade is welded to terminal arm.

4 Claims, 1 Drawing Sheet

MEANS FOR MOUNTING A BIMETAL BLADE IN A THERMOSTATIC SWITCH

FIELD OF THE INVENTION

The present invention relates to a thermostatic switch having a bimetal blade connected to a terminal arm, and more particularly, to a thermostatic switch wherein the bimetal blade is mechanically connected to the terminal arm by means of a fastener and electrically connected to the terminal arm by means of a weld.

BACKGROUND OF THE INVENTION

Thermostatic switches have long been used to provide a protective, temperature responsive switch that automatically breaks contact between a power supply and the wiring of an electrical component upon an increased temperature of the ambient that would subject the component to damage and that automatically re-establishes contact after the ambient has cooled to a safe level of temperature. Thermostatic switches can include a temperature responsive bimetal blade connected, at one end, to an electrically conductive member, such as a terminal arm, with the other end freely extending towards a fixed contact. Upon a change in temperature from the ambient, the central portion of the bimetal blade deflects to move a movable contact, connected to its other freely extending end, to a position either against or spaced from the fixed contact. As can be appreciated, when the contacts are spaced from one another a circuit open condition of the switch is established and when the contacts are against one another a circuit closed condition of the switch is established.

The bimetal blade is designed such that its central portion deflects at a selected operating temperature to produce the circuit open and the circuit closed conditions of the switch. As is well known in the art, the central portion can have a dish-like, snap action depression to produce a snap action of the switch. In such a case, the design features of the blade, including its metallic constituents and the size and the depth of the depression, are carefully selected to form a blade having a predetermined mechanically set, calibration temperature to produce a specific snap point of the blade. Additionally, as with any other dynamic alternately stressed, mechanical component, a bimetal blade is designed for a total number of cyles of deflections between the circuit open and circuit closed positions before failure.

The connection of the blade to the terminal arm, being adjacent to the central flexing portion of the blade, is a critical component of the design of a thermostatic switch because the type of connection chosen can change the carefully engineered operating temperature and projected life of the blade. In the prior art, the preferred method of connecting the blade is to weld the end of the bimetal blade to a terminal arm. Although the weld assures an electrical connection and provides a mechanical connection, the heat generated during the application of the weld weakens the central flexing portion of the bimetal blade. This weakening reduces the projected life of the blade and further shifts the predetermined mechanically set, calibration temperature of the blade. Also in the prior art, bimetal blades have been connected by riveting the blade to a terminal arm. While such a connection does not decrease the projected life of the blade, nor shift its operating temperture, an electrical connection is not assured. These prior art methods of connection are mutually exclusive in that only one or the other method of connection has been used.

In a preferred embodiment of the present invention, a fastener is used to connect the bimetal blade to a terminal arm to prevent the possible weakening of the central flexing portion of the blade as would occur with welding. A weld is also used to connect the bimetal blade to the terminal arm to assure an electrical connection. The weld is, however, situated on the end of the blade so that the fastener is located between the weld and the central flexing portion. The improved connection of the present invention, that utilizes both types of connection, to wit: a fastener and a weld, produces advantages that are not found in either of the methods of connection standing alone. The most important advantage relates to the location of the weld relative to the fastener and the central flexing portion of the blade. In the present invention the weld is remotely located from the central flexing portion of the blade because the fastener is located between the weld and the central flexing portion of the blade. As a result, not only is an electrical connection assured by the weld, but in addition, the central flexing portion is not subjected to elevated temperatures produced during the application of the weld that can detrimentally affect the engineered design characteristics of the blade. As stated previously, the design characteristics of conventionally welded blades are upset by the welding process. Moreover, the fastener being located close to the central flexing portion of the blade assures a stable mechanical connection of the blade. The addition of the weld assures an electrical connection that would not be produced by the fastener connection alone. Thus, a very stable mechanical and electrical connection is provided by the present invention that does not affect the design characteristics of the blade and is not produced in the prior art welded and rivetted connections.

SUMMARY OF THE INVENTION

The present invention provides an improvement to a thermostatic switch of the type that comprises an electrically conductive member, a fixed contact, means for mounting the electrically conductive member and the fixed contact with the fixed contact facing towards the electrically conductive member, a bimetal blade and a movable contact connected to the bimetal blade. The bimetal blade is connected, at one of its ends, to the electrically conductive member with the other of its ends freely extending along a side of the electrically conductive member facing towards the fixed contact. The movable contact is connected to the other end of the bimetal blade and faces towards the fixed contact. Additionally, the bimetal blade has a central, flexing portion, connecting its ends and adapted to flex in response to a temperature change from the ambient between two positions. In one position, the movable contact is located against the fixed contact to form a circuit closed condition of the switch and in another position, the movable contact is spaced from the fixed contact to form a circuit open condition of the switch.

In the improvement, the one end of the bimetal blade has a first bore and the electrically conductive member has a second bore located thereon so as to be in alignment with the first bore. A fastener is located within the first and second bores. The fastener prevents misalignment of the bores and prevents separation of the electrically conductive member from the bimetal blade at the bores. A weld electrically connects the one end of the bimetal blade to the electrically conductive member. The weld is situated on the bimetal blade such that the first and second bores and hence, the fastener are located between the weld and the central flexing position of the bimetal blade. As a result, the central flexing portion is not weakened by the heat generated in applying the weld.

DETAILED DESCRIPTION OF THE INVENTION

Figure 1:
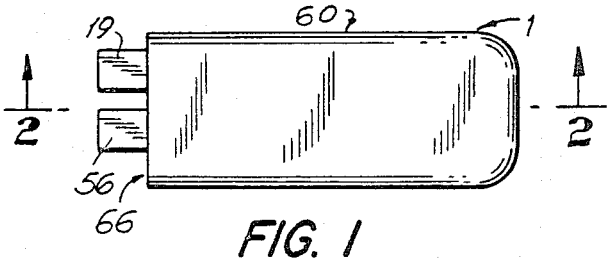
FIG. 1 is a top plan view of an improved thermostatic switch of the present invention mounted in a case.
Figure 2:
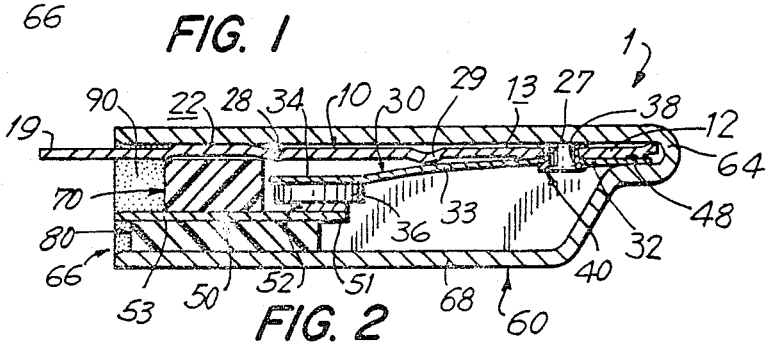
FIG. 2 is cross-sectional view of FIG. 1 taken along line 2—2 of FIG. 1.

With reference to FIGS. 1 and 2, the improved thermostatic switch 1 of the present invention preferably includes a pair of first and second terminal arms 10 and 50 supported by insulating members 70 and 80 within a case 60. The bimetal blade 30, shown in a circuit closed condition of the thermostatic switch 1, is adapted to deflect in response to a temperature change. As illustrated, in the circuit closed condition, a movable contact 36 bears against the fixed contact 52 of the second terminal arm 50. In the circuit open condition of the thermostatic switch 1, the bimetal blade 30 deflects towards the first terminal arm 10 so that the movable contact 36 of the blade 30, is spaced from the fixed contact 52. One of the ends 32 of the bimetal blade 30 is connected to one end 12 of the first terminal arm 10 by the improved means of the present invention which preferably comprise a fastener, such as an illustrated eyelet 40, and a weld 48.

Figure 3:
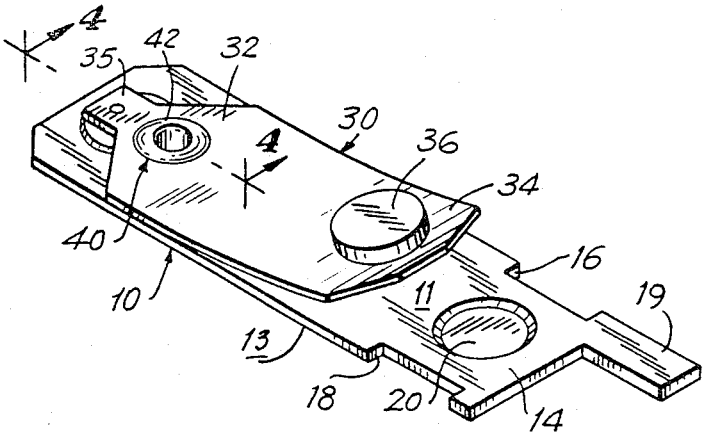
FIG. 3 is a front perspective view of a first terminal arm and a bimetal blade of the thermostatic switch, connected to one another by the improved means of the present invention.
Figure 4:
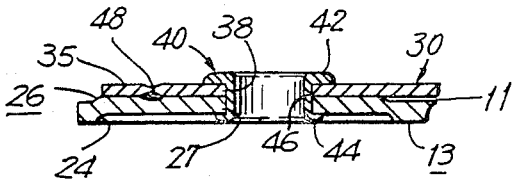
FIG. 4 is a fragmentary, cross-sectional view taken along line 4—4 of FIG. 3.

With reference now to FIGS. 2 and 3, the preferred first terminal arm 10 can have a substantially rectangular configuration. The other end 14 of the first terminal arm can be provided with a pair of opposed notches, 16 and 18, for purposes that will be discussed hereinafter. A terminal lug 19, well known in the art, can be integrally formed from the end 14 to provide a point at which the thermostatic switch 1 is operable to be electrically connected. End 14 can also be provided with a circular connection depression 20 in a surface 11 of terminal arm 10 to form a raised connection surface 22 in the opposite surface 13 of the first terminal arm 10. The purpose of this raised surface 22 will be discussed in greater detail hereinafter. With reference to FIG. 4, the opposite surface 13 at end 12 has a dish-like depression 24 that produces a raised pedestal surface 26 in the surface 11 for attaching the bimetal blade 30. Additionally, the first terminal arm 10 can be provided with a limit stop projection 28 integrally formed from surface 11 and located so as to be adjacent to end 34 of blade 30. Projection 28 prevents the end 34 of the bimetal blade 30 from welding to the first terminal arm 10 due to electrical arcing between the contacts 36 and 52. First terminal arm 10 can also, preferably be provided with a fulcrum-like projection 29. Projection 29 is integrally formed from surface 11 and is spaced between ends 12 and 14 of arm 10 so as to be directly opposite a central flexing portion 33 of blade 30. In this regard central flexing portion 33 can include a well known depression that produces a snap action of the blade 30. Projection 29 has a height to forceably bear against the flexing portion 33 of blade 30. As is well known in the art, the height selected and thus the force exerted on central portion 33 can be used to calibrate the temperature at which central portion 33 flexes into a position towards terminal arm 10 and hence the circuit open condition of switch 1.

With reference now to FIGS. 3 and 4, the bimetal blade 30 is connected, at end 32, to the first terminal arm 10 at the preferred pedestal surface 26. The movable contact 36 is preferably connected to the other end 34. As illustrated, end 34 freely extends along a side, or in the case of the preferred embodiment, the surface 11 of the first terminal arm 10 that faces towards the second terminal arm 50. First terminal arm has a second bore 27 located thereon so as to be aligned with the first bore 38 of blade 30. The bimetal blade 30 can preferably have a rectangular configuration and the end 32 thereof can also preferably be provided with an outwardly extending, square-like tab 35. The tab 35 is oriented in a direction opposite to the end 34 of the bimetal blade 30.

With reference to FIG. 4, a fastener, such as illustrated eyelet 40, is preferably utilized to connect the bimetal blade 30 to the first terminal arm 10. Weld 48 is situated so that the bores 27 and 38 and hence, the eyelet 40, are located between weld 48 and the central flexing section 33. Section 33 is therefore, not weakened by the heat stress that is induced during the conventional welding of the bimetal blade 30. The eyelet 40 has a pair of opposed, spaced flanges 42 and 44 which respectively bear against the bimetal blade 30 and the first terminal arm 10 to form a means to prevent separation of the bimetal blade 30 from the first terminal arm 10. As illustrated, the depression 24 serves an additional function of providing a countersink for the eyelet 40 such that the flange 44 is level with the surface 13 of the first terminal arm 10. The eyelet 40 also has a central, tubular section 46 sized to closely fit within the first and second bores 38 and 27. As illustrated, the central section 46 connects the flanges 42 and 44 to one another at opposite ends thereof. A weld 48 is provided to electrically connect the bimetal blade 30 to the first terminal arm 10. The weld is situated on the bimetal blade 30 such that the bores and eyelet are located between the weld 48 and the central flexing portion 33 of the bimetal blade 30. The weld 48 is thus advantageously utilized to accomplish an electrical connection between the end 32 of the bimetal blade 30 and the first terminal arm 10 in a non-critical, non-flexing portion of the bimetal blade 30. As illustrated, the weld 48 is conveniently located at the tab 35 of the bimetal blade of the illustrated, preferred embodiment.

The second terminal arm 50, as stated previously, has a fixed contact 52 located at the end 51 thereof. The other end 53 of the second terminal arm 50 is formed into a terminal lug 56 to accomplish an electrical connection of the thermostatic switch 1. Although not illustrated, the end 53 can be notched as in the case of the end 14 of first terminal arm 10.

With reference to FIGS. 1 and 2 again, the first and second arms 10 and 50 and the bimetal blade 30 are preferably mounted within the case 60. Case 60 has an end 64 of reduced cross-sectional area to support the bimetal blade 30 and the first terminal arm 10 within the case 60. The terminal lugs 56 and 19 extend from an open end 66 of the case 60. The second terminal arm 50 is supported within the case 60 by means of insulating members 70 and 80. As illustrated, insulating member 70 is located between first terminal arm 10 and second terminal arm 50. Insulating member 80 is located between the second terminal arm 50 and a bottom wall 68 of the case 60. The respective thicknesses of the insulating members 70 and 80 are chosen such that the assemblage of the insulating members 70 and 80 and first and second terminal arms 10 and 50 are located in the open end 66 of the case 50 in a force fitting relationship. To this end, the connection surface 22 further assures the force fitting relationship. The insulating member 70 can preferably comprise an insulating cradle in the form of an H, and the insulating member 80 can comprise a separator The insulating cradle and separator combination is fully described in U.S. Pat. No. 4,374,372, which is hereby incorporated by reference. In practice, the arms of such a cradle would extend into notches 16 and 18, as well as like notches of second terminal arm 50 and the separator (member 80) to attach the cradle and separator to the first and second terminal arms 10 and 50. The H channel and separator insulate the second terminal arm 50 from the case 60 and also, the first terminal arm 10. As can best be seen in FIG. 2, epoxy, illustrated by 90 can also preferably be provided within the open end 66 to seal the case 60.

The present invention has been described relative to a preferred embodiment that incorporates a pair of terminal arms mounted in a case with a fixed contact mounted on one of terminal arms. It is understood however, that the present invention could be equally applicable to any thermostatic switch in which a fixed contact is connected to an electrically conductive member and a bimetal blade is connected to another electrically conductive member. For instance, the terminal arm 10, upon which the bimetal blade 30 is connected, could be replaced by an insulated, electrically conductive lid of an electrically conductive can. In such an application of the present invention the fixed contact would be connected to the basewall of the can, opposite to the lid.

While specific embodiments of inventions have been shown and described, the invention should not be considered as so limited, but as limited only as set forth in the appended claims.

I claim:

1. In a thermostatic switch of the type comprising:

an electrically conductive member; a fixed contact; means for mounting said electrically conductive member and said fixed contact with said fixed contact facing towards said conductive member; an elongated, electrically conductive bimetal blade that is connected, at one of its ends, to said conductive member with the other of its said ends freely extending along a side of said conductive member facing towards said fixed contact; and a movable contact, connected to the said other end of said bimetal blade, facing towards said fixed contact; said bimetal blade having a central, flexing portion, connecting its said ends and adapted to flex in response to a temperature change from the ambient between a position in which said movable contact is located against the said fixed contact to form a circuit closed condition of said switch and another position in which said movable contact is spaced from said fixed contact to form a circuit open condition of said switch; the improvement comprising:

said one end of said bimetal blade having a first bore;

said electrically conductive member having a second bore located thereon so as to be in alignment with said first bore;

a fastener located within said first and second bores to prevent misalignment of said bores and to prevent separation of said electrically conductive member from said bimetal blade at said bores; and a weld, electrically connecting said one end of said bimetal blade to said electrically conductive member, said weld being situated on said bimetal blade, such that said first and second bores and hence, said fastener are located between said weld and said central flexing portion of said bimetal blade, whereby said central flexing portion is not weakened by the heat generated in applying said weld.

2. The thermostatic switch of claim 1 wherein said fastener comprises an eyelet including:

a pair of opposed, spaced annular flanges, located at said first and second bores with said electrically conductive member and said bimetal blade being situated between said flanges and said flanges bearing against said electrically conductive member and said bimetal blade to prevent separation of said bimetal blade from said electrically conductive member; and a central, tubular section sized to closely fit within said first and second bores, said tubular section connecting said annular flanges to one another, said tubular section located within said first and second bores to prevent misalignment of said bores.

3. The thermostatic switch of claim 1 wherein:

said bimetal blade has a rectangular configuration and its said one end has an outwardly extending, square-like tab integrally formed from said one end, said tab being oriented in a direction opposite to said other end of said bimetal blade; and said weld electrically connects said tab to said electrically conductive member.

4. The thermostatic switch of claim 2 wherein:

said bimetal blade has a rectangular configuration and its said one end has an outwardly extending, square-like tab integrally formed from said one end, said tab being oriented in a direction opposite to said other end of said bimetal blade; and said weld electrically connects said tab to said electrically conductive member.

* * * * *